United States Patent [19]

Olson et al.

[11] 3,990,594

[45] Nov. 9, 1976

[54] FLUID-ACTUATED CLAMPING APPARATUS AND CIRCUIT

[75] Inventors: John E. Olson, Portland, Oreg.; Richard D. Seaberg, Vancouver, Wash.

[73] Assignee: Cascade Corporation, Portland, Oreg.

[22] Filed: Aug. 29, 1975

[21] Appl. No.: 608,906

[52] U.S. Cl. ..... 214/653; 214/651; 91/413

[51] Int. Cl.[2] ..... B66F 9/22

[58] Field of Search ..... 214/653, 651, 730; 91/411 R, 411 B, 413

[56] References Cited

UNITED STATES PATENTS

| | | | |
|---|---|---|---|
| 3,166,207 | 1/1965 | Quayle | 214/653 |
| 3,184,088 | 5/1965 | Berge | 214/653 |
| 3,738,520 | 6/1973 | Didtel et al. | 214/653 |
| 3,795,177 | 3/1974 | Cryder et al. | 91/411 R |
| 3,818,801 | 6/1974 | Kime | 91/411 B |
| 3,824,896 | 7/1974 | Tull | 91/411 B |

*Primary Examiner*—Trygve M. Blix
*Assistant Examiner*—Gregory W. O'Connor
*Attorney, Agent, or Firm*—Kolisch, Hartwell, Dickinson & Stuart

[57] ABSTRACT

A load-clamping apparatus wherein the loaded and unloaded condition of the clamping arms (respecting their contacting an external body) is automatically sensed, and used to determine the type of fluid connections which exist at any given moment between fluid motors that move the arms. With the arms moving toward one another, so long as the movement of neither arm is hindered by an external body, a series connection exists between the motors producing relatively high-speed low-power relative movement between the arms. When such hindering occurs, a parallel connection is produced which results, during clamping, in lower-speed higher-power relative movement between the arms.

One embodiment of the invention takes the form of apparatus capable simply of producing relative movement between clamping arms toward and away from one another to clamp and release a load. Another embodiment enables this action, plus reversible, common-direction side-shifting of the arms.

12 Claims, 3 Drawing Figures

FLUID-ACTUATED CLAMPING APPARATUS AND CIRCUIT

BACKGROUND AND SUMMARY OF THE INVENTION

This invention pertains to a load-clamping apparatus, and more particularly to such an apparatus wherein the loaded and unloaded condition of the clamping arms (respecting their contacting an external body) is automatically sensed, and used to determine the type of fluid connections which exist at any given moment between fluid motors that move the arms.

For a number of reasons, more and more lift trucks are being powered by electric batteries as distinguished from gasoline. Historically, hydraulically operated lift truck attachments have been designed to be compatible with the pressure and flow characteristics practically obtainable from hydraulic pumps driven by internal combustion engines. The trend toward increased use of electric lift trucks has created a need for more efficient hydraulic circuitry to operate such attachments, in order to take into account the substantially more time-consuming, and hence costly, process of recharging batteries in an electric lift truck, as distinguished from refueling of a gasoline powered truck. For example, if a gasoline-powered truck requires refueling during a typical 8-hour work shift, this is a matter which can be accomplished relatively quickly, and hence, relatively inexpensively. In other words, the downtime for such refueling is quite minimal. By contrast, however, recharging of batteries in an electric truck may take a considerable amount of time, and thus is to be avoided, if at all possible, during the period of a work shift. Accordingly, and in order to recognize the above-mentioned trend, as well as to recognize the general concern today for energy conservation, it is important to maximize the efficiency of hydraulic circuitry used in conjunction with lift-truck attachments, so as to make more conservative and efficient use of the power available in electric batteries.

An important object of the present invention, therefore, is to provide a unique hydraulic circuit usable in conjunction with a lift-truck attachment, such as a clamping mechanism, which circuit offers significantly greater efficiency than previously known circuits employed for the same general purpose.

More specifically, an object of the invention is to provide such a circuit wherein the loaded and unloaded conditions of clamping arms in a clamping mechanism (respecting their contacting an external body) is automatically sensed, and used to determine the nature of fluid connections which exist at any given moment between fluid motors that move the arms.

As will become apparent from the description below, when it is most appropriate that the arms move in what might be thought of as a high-speed, low-power mode of operation, connections are automatically produced between the motors and the main supply of hydraulic fluid which assure such action, with a minimal requirement for pumped pressure fluid to accomplish this. Similarly, when it is most appropriate that the arms move in what might be thought of as a low-speed, high-power mode of operation, different connections are produced between the motors which assure this action. Again, fluid flow to accomplish such action is held to a minimum.

The capability of the novel arrangement proposed herein to enable such different operating modes makes a maximum use of each unit amount of oil which must be pumped, and hence maximizes the efficiency of use of such oil. In addition, the proposed arrangement takes into account the fact that energy consumption from a battery is a function of the amount of amperage drawn from the battery, as well as the lengths of time that different amperages are drawn. Experience has shown that the proposed circuit when incorporated and used in conjunction with a conventional electrically powered lift truck, can enable normal, uninterrupted use of such a truck throughout the usual 8-hour work shift.

Disclosed herein are two related modifications of apparatus offering the features and advantages generally discussed above. These two modifications are disclosed in connection with two slightly different kinds of clamping needs often required for lift truck clamps. One of these modifications is referred to herein as a basic clamping apparatus which is usable simply for shifting a pair of opposed load-clamping arms toward and away from each other to clamp against and release a load. The other modification is referred to as a basic and side-shifting clamping apparatus, and is one which is usable not only for the same purposes as the basic clamping apparatus, but also for shifting a load from side-to-side.

In both modifications, with the arms moving toward one another, so long as the movement of neither arm is hindered by an external body, a series connection exists between the motors which move these arms, which connection produces relatively high-speed low-power relative movement between the arms. When movement of either arm is hindered, however, for example by one of the arms engaging the side of a load, a parallel connection is produced between the motors, which connection prepares the motors for lower-speed higher-power relative movement between the arms during clamping. As will be explained, under all circumstances of arm movement, the proposed invention minimizes the amount of pumped fluid which is required to produce such movement.

These and other objects and features of the invention will become more fully apparent as the description which now follows is read in conjunction with the accompanying drawings.

DRAWINGS

DETAILED DESCRIPTION OF THE INVENTION

Figure 1:
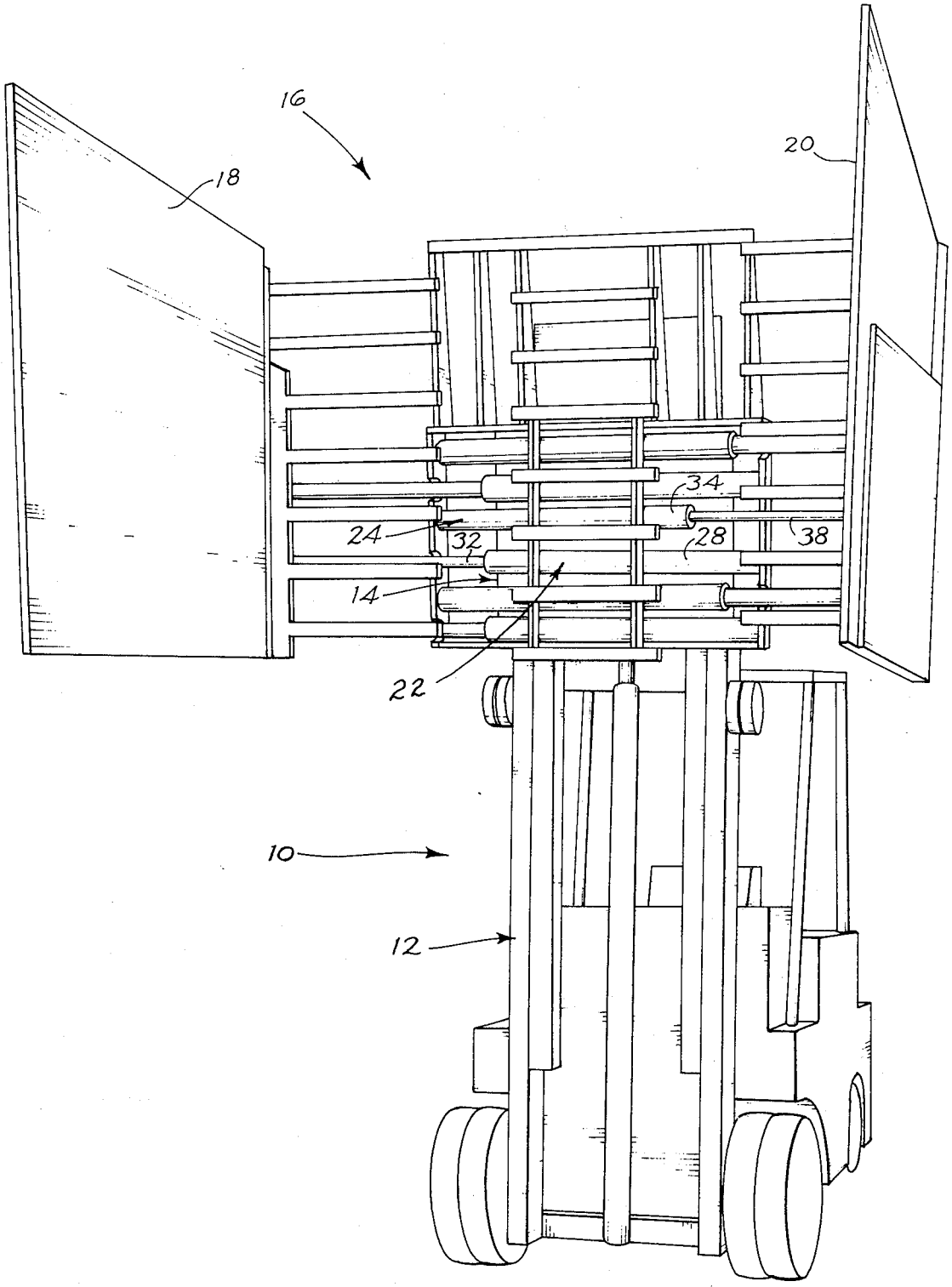
FIG. 1 is a simplified front perspective view of a lift truck employing a clamping apparatus constructed in accordance with the present invention.

Turning now to the drawings, and referring first to FIG. 1, indicated generally at 10 is a conventional lift truck, including the usual vertically extensible-contractible mast 12, and vertically raisable and lowerable carriage 14. Mounted on this carriage is a load clamping mechanism 16, including a pair of opposed relatively movable clamping arms 18, 20 which are moved by double-acting hydraulic motors 22, 24, respectively. Hydraulic circuitry, not shown in FIG. 1, constructed in accordance with the present invention, connects with motors 22, 24 in a manner which will shortly be described, for the purpose of controlling the operation of the motors, and hence for controlling the movements of the clamping arms.

1. The Embodiment of FIG. 2

Figure 2:
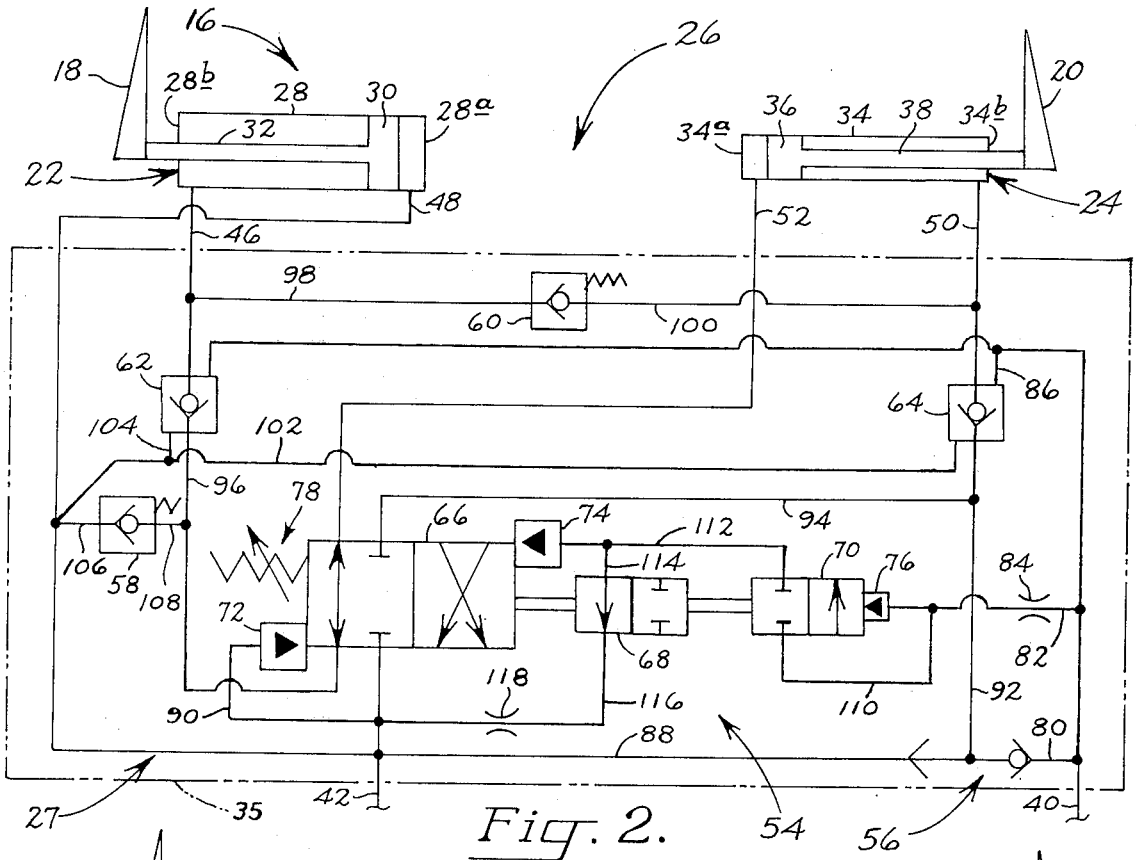
FIGS. 2 and 3 are schematic diagrams illustrating two different modifications of the proposed clamping apparatus.

Considering FIG. 2, what is shown herein, generally schematically at 26, is one embodiment of clamping apparatus, as proposed by the invention, wherein hydraulic circuitry 27 is provided that equips the apparatus for operation as what has been referred to previously as a basic clamping apparatus. As can be seen, previously mentioned arms 18, 20 and motors 22, 24 are shown in this figure in extremely simplified form.

In apparatus, or system, 26, motor 22 includes the usual cylinder 28 in which is mounted a piston 30 that is connected to a projecting rod 32. The butt and rod ends of cylinder 28 are shown at 28*a*, 28*b*, respectively. Similarly, motor 24 includes a cylinder, piston and rod 34, 36, 38, respectively. The butt and rod ends of cylinder 34 are shown at 34*a*, 34*b*, respectively. Clamping arms 18, 20 are suitably attached to the outer ends of rods 32, 38, respectively, whereby reciprocal movement of the pistons in the cylinders effects movement of the arms.

It should be noted that motors 22, 24 are of different sizes, with the former being larger than the latter. The relative sizes of these two motors have been chosen whereby the working surface area for pressure fluid on the butt end side of piston 36 is substantially the same as that on the rod end side of piston 30. For the modification of the invention now being described, this working surface area size relationship is important.

Indicated at 40, 42 are two conduits, or conduit means, which connect with a conventional supply of pressure fluid that is provided on truck 10. Conduits 40, 42 supply and exhaust pressure fluid with respect to motors 22, 24, through a valving means, shown within dash-double-dot block 35 which is constructed in accordance with the present invention. This valving means is referred to also both as operating-mode-change fluid circuitry, and as a changable-condition fluid-flow directing means. As will become apparent shortly, valving means 35 effects different kinds of fluid interconnections between the motors and conduits 40, 42, for directing fluid flow to and from the motors. The valving means connects with the rod and butt ends of cylinder 28 through conduits 46, 48, respectively, and to the rod and butt ends of cylinder 34 through conduits 50, 52, respectively.

Considering the construction of valving means 35, included within this means are a differential pilot-operated sequence valve 54, a shuttle valve 56, a pair of spring-biased check relief valves 58, 60, and a pair of vented, pilot-operated check valves 62, 64.

Valve 54 is shown as comprising three valve spools, including a sequencing valve spool 66, and a pair of piloting valve spools 68, 70. Each of these three spools is represented as a rectangle divided into two squares, with the flow that is permitted through the spool depicted by the markings contained within the squares. Spools in valve 54 are shown in what may be thought of as their normal positions. Associated with the left and right ends of spool 66 in FIG. 2, are piston actuators 72, 74, respectively. Associated with the right end of spool 70 in FIG. 2 is a piston actuator 76. It should be noted that the effective working surface area for pressure fluid on actuator 74 is considerably larger than that on actuator 76. The reason for this difference will be explained later. Spools 66, 68, 70 physically interact with one another, whereby movement of one moves the others. An adjustable spring-biasing mechanism, shown generally at 78, acts on the left end of spool 66 in FIG. 2, urging this spool, as well as spools 68, 70, to the right in the figure.

It will be appreciated by those skilled in the art that there are a variety of different ways in which a sequence valve like valve 54 may physically be constructed. The precise construction of such a valve forms no part of the way in which this valve interacts with other components of the invention, and hence details of a selected construction are not specifically shown or discussed herein. For example, in addition to the many different ways in which the spools and actuators within valve 54 may be constructed relative to one another, the component of valve 54 may be combined, if desired, in a unitary housing which also contains one or more of valves 56–64, inclusive. Or, the different valves may be separate units.

Considering now the various conduit connections which exist between the components shown in FIG. 2, previously mentioned conduit 40 connects through a conduit 80 with the right input side of shuttle valve 56 in FIG. 2, through a conduit 82 and a flow restrictor 84 with the work surface side of piston actuator 76, through a conduit 86 with the vent side of valve 64, and directly with the vent side of valve 62. Conduit 42 connects through a conduit 88 with the left input side of the shuttle valve in the figure, directly with previously mentioned conduit 48, through a conduit 90 with the working surface side of piston actuator 72, and directly with the bottom side of spool 66 in FIG. 2.

A conduit 92 interconnects the output of the shuttle valve with the seat side of valve 64, this conduit also connecting through a conduit 94 with the upper side of spool 66 in FIG. 2. The ball side of valve 64 connects directly with conduit 50.

Previously mentioned conduit 46 connects with the ball side of valve 62 — the seat side of this valve being connected through a conduit 96 with the bottom side of spool 66 in FIG. 2. Previously mentioned conduit 52 connects directly with the top side of spool 66 in FIG. 2.

Conduits 98, 100 connect the seat and ball sides, respectively, of valve 60 with conduits 46, 50, respectively. Piloting for valves 62, 64 is provided by conduits 102, 104, with conduit 102 connecting the pilot side of valve 64 directly with conduit 48, and connecting conduit 48 with the pilot side of valve 62 through conduit 104. The seat and ball sides of valve 58 connect through conduits 106, 108, respectively, with conduits 48, 96 respectively.

Completing a description of what is shown in FIG. 2, a conduit 110 connects conduit 82 with the lower side of spool 70 — the upper side of this spool being connected through a conduit 112 with the working surface side of piston actuator 74, and through conduit 112 and a conduit 114 with the upper side of spool 68 in FIG. 2. A conduit 116 connects the lower side of spool 68 in FIG. 2 through a flow restrictor 118 with previously mentioned conduit 42.

2. Operational Description For FIG. 2

Considering now the operation of the apparatus shown in FIG. 2, let us assume that clamping arms 18, 20 are initially disengaged from any external body, and it is desired to move them toward one another to clamp onto a load. To accomplish this, the usual main control valve (not shown) included on the lift truck is adjusted to supply pressure fluid through conduit 40, and to exhaust fluid through conduit 42. As a consequence, the ball within shuttle valve 56 shifts to the left in FIG. 2 admitting pressure fluid to conduit 92. Such fluid then flows through valve 64 and conduit 50 to the rod end of cylinder 34. Fluid flow through conduit 94 and spool 66 is, at this time, blocked. As a consequence, the piston in motor 24 begins moving to the left in FIG. 2, with pressure fluid then exhausting from the butt end of cylinder 34. As can be seen, this exhausting fluid flows directly into the rod end of cylinder 28 through conduit 52, spool 66, conduit 96, valve 62, and conduit 46. Thus, the piston in motor 22 begins moving to the right in FIG. 2.

Because of the fact that the working surface area on the butt end side of piston 36 is essentially the same as that on the rod end side of piston 30, simultaneous equal movements, in opposite directions, are produced in arms 18, 20. More specifically, for each given unit distance that arm 20 moves to the left in FIG. 2, arm 18 moves an equal distance to the right in the figure. Fluid contained in the butt end of cylinder 28 exhausts through conduit 48 to conduit 42. It will be noted that, considering all of the available working surface areas on the two pistons in the motors, closure of the arms upon one another to clamp against a load results from the directing of pressure fluid to the very smallest of these working surface areas. This working surface area is, namely, that on the rod end side of piston 36. Also, it will be noted that the motors are, under such circumstances, connected essentially in series with one another, with pressure fluid being supplied from the main supply on the lift truck only to one side of one of the motors. Thus, it will be apparent that only a minimum amount of pumped pressure fluid is required to produce a given amount of clamping arm travel during closing of the arms. Also, since the motors are connected essentially in series, a given amount of pressure fluid flow produces a maximum amount of arm travel speed. Accordingly, unimpeded closing of the clamping arms can be accomplished with relatively high efficiency respecting both the amount of pumped pressure fluid which is required, and also respecting the amount of time required for the arms to close a given distance.

Until movement of one of the two clamping arms toward the other becomes impeded by contact with the side of a load, the situation just described remains unchanged. All during this time, it should be noted, that sequence valve 54 is, in essence, sensing the pressure difference between conduits 40, 42. Sensing of the pressure within conduit 40 is accomplished through conduit 82 and piston actuator 76. Sensing of the pressure within conduit 42 is accomplished through conduit 90 and piston actuator 72.

When travel of one of the arms becomes impeded as described, the situation changes. More specifically, the pressure within conduit 40 builds very rapidly relative to that within conduit 42, and when the pressure difference between fluid in these two conduits reaches a certain level, actuator 76 begins to shift pool 70 to the left in FIG. 2. This pressure difference in apparatus 26 is about 1750 psi. With movement of spool 70 to the left a slight distance, the flow conditions through spools 68, 70 change. In particular, and considering spool 70, flow takes place between conduits 110, 112 as indicated by the arrow on the right side of spool 70 in FIG. 2. Simultaneously, the fluid connection which previously existed through spool 68 between conduits 114, 116 is broken. As a consequence, pressure fluid, at the same pressure as that in conduit 40, is now applied to the working surface side of piston actuator 74. Actuator 74, now in cooperation with actuator 76, causes rapid movement of spool 66 to the left in FIG. 2, whereupon flow through this spool changes from that indicated within the left square in the spool, to that indicated within the right square in the spool.

It will be noted that this shifting of spool 66 produces a parallel connection between motors 22, 24, whereupon pressure fluid tends to flow simultaneously into the rod ends of the cylinders from conduit 40, and to exhaust simultaneously from the butt ends of the cylinders to conduit 42.

As will become apparent shortly with such shifting of spool 66, the pressure difference between fluid in conduit 40 and that in conduit 42 drops significantly. It is important that this pressure difference drop not effect a return of spool 66 to the position shown for it in FIG. 2. This concern, plus the fact that it is desirable to effect a relatively rapid shifting of spool 66 substantially precisely when the pressure difference mentioned earlier reaches the level indicated, is the reason why the working surface areas of actuators 74, 76 are different. More specifically, initially only the working surface area of actuator 76, the smaller of the two areas, is exposed to pressure fluid within conduit 40. Because of the relatively small size of this area, a significant pressure must be reached within conduit 40 relative to conduit 42 before the actuator can shift spool 70 far enough to communicate this pressure fluid to the working surface side of actuator 74. However, when such pressure fluid is applied to actuator 74, the considerably larger area of the working surface of this actuator, in conjunction with the smaller area on actuator 76, produces a greatly increased shifting force on spool 66, causing this spool to shift rapidly to the left in FIG. 2. Also, the combined working surface areas of actuators 74, 76 now permit a considerable drop in the pressure of fluid in conduit 40 before biasing mechanism 78 is able to return spools 66, 68, 70 to the positions in which they are shown in FIG. 2. While different specific lower pressure differences may be selected for allowing return of the spools, a specific pressure difference which has been selected herein for apparatus 26 is about 150 psi.

Considering further the impeded-arm situation now being discussed, let us assume that the first one of the two clamping arms to engage the side of a load is arm 18. If this is the case, movement of arm 18 stops, with pressure fluid continuing to be supplied to the rod end of cylinder 34, at the same flow rate, thus continuing movement of arm 20 toward the load at the same speed which it initially had. If the reverse situation were true, namely, that it is arm 20 which first engages the side of a load, movement of this arm stops, with pressure fluid continuing to be supplied to the rod end of cylinder 28. Because the working surface area on the rod end side of piston 30 is larger than that on the rod end side of piston 36, arm 18 continues moving toward the load, but at a somewhat slower rate.

When both arms have engaged the load, a clamping force is built up between the arms, with extremely slow high-power relative movement between the arms — arm 18 tending to move toward arm 20, with the latter tending to remain stationary. The reason for this, of course, is that in the parallel-connected condition of motors 22, 24, the rod end side of piston 30 presents a greater working surface area than the rod end side of piston 36. Valves 60, 64, of course, prevent the escape of fluid from the rod end side of cylinder 34. When a sufficiently great clamping force has been built up, the supply of pressure fluid through conduit 40 is cut off, with valve 62 then preventing the escape of fluid from the rod end of cylinder 28. Thus, the load is now clamped between the arms.

To release the load, pressure fluid is supplied from the main supply on the truck to conduit 42, and is exhausted from conduit 40. As pressure fluid is supplied through conduit 42, the ball in shuttle valve 56 shifts to the position shown for it in FIG. 2, and piston actuator 72, in cooperation with mechanism 78, shifts spools 66, 68, 70 to the positions shown for them in FIG. 2. Pilot-operated check valves 62, 64 are piloted open, thereby allowing fluid to escape from the rod ends of cylinders 28, 34.

It will be noted that once again motors 22, 24, are connected effectively in series. Fluid supplied through conduit 42 flows through conduit 48 to the butt end of cylinder 28. Fluid exhausting from the rod end of this cylinder flows to the butt end of cylinder 34, with fluid then exhausting from the rod end of cylinder 34 back toward conduit 42. Because the pressure of fluid in conduit 42 is at this time less than that of fluid exhausting from the rod end of cylinder 34, the fluid which exhausts from cylinder 34 becomes a regenerative flow, adding to that which is entering through conduit 42, to speed the opening of the arms. In other words, arm opening under these circumstances occurs at a considerably higher speed than initial arm closing toward a load. This increased speed during opening of the arms, of course, increases the time and energy efficiency of apparatus 26.

Should either arm, during opening, strike some external object, its movement stops, and the other arm continues opening. For example, if opening of arm 18 is hindered, valve 58 opens to bypass fluid past motor 22. Similarly, if outward movement of arm 20 stops, valve 60 opens to bypass motor 24.

Considering, for a moment, the functions of flow restrictors 84, 118, restrictor 84 acts as a shock absorber between conduit 40 and actuator 76. It prevents inadvertent shifting of spools 66, 68, 70 at the time when pressure fluid is first supplied in conduit 40 to close the arms. Restrictor 118 functions, during shifting of the spools, to allow adequate pressure to build up on actuator 74.

3. The Embodiment of FIG. 3

Figure 3:
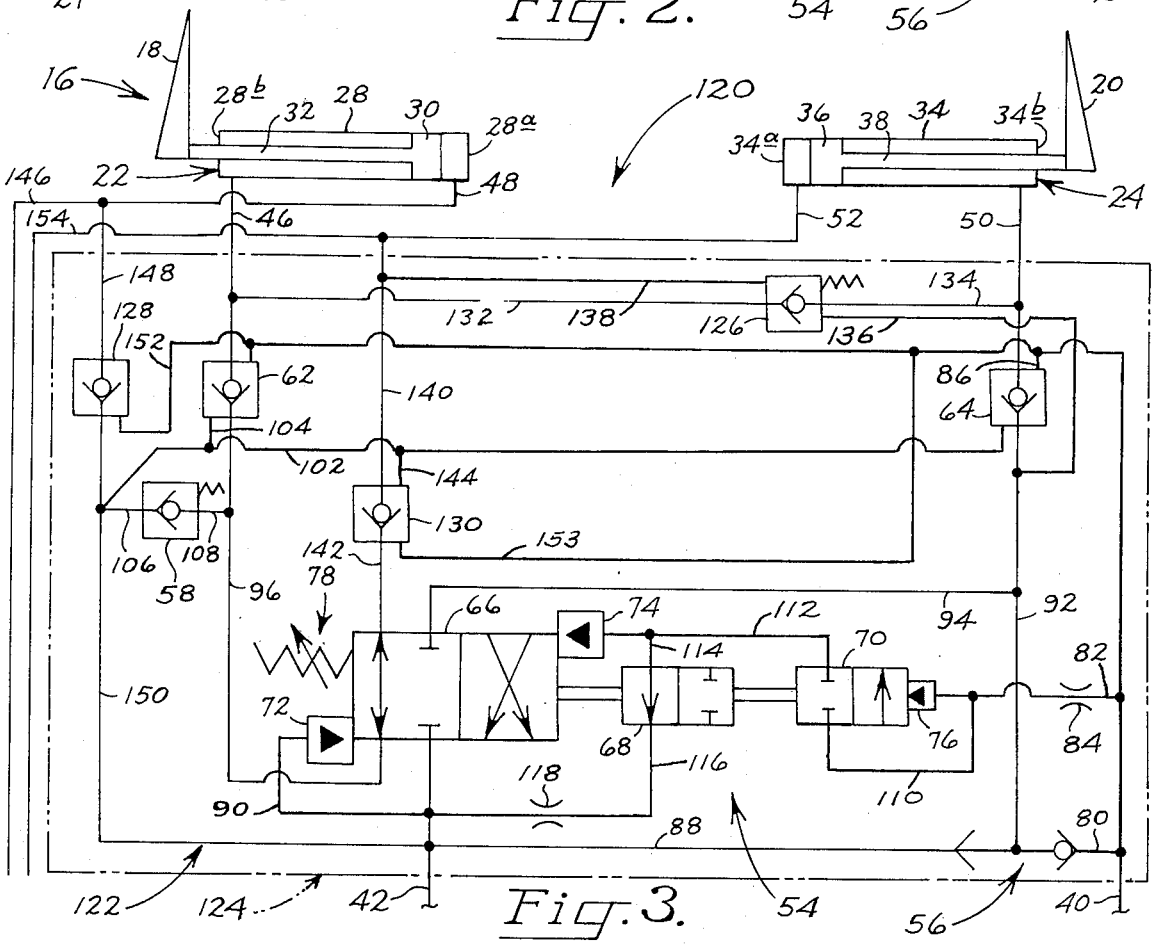

Turning now to FIG. 3, what is shown herein, generally schematically at 120, is another embodiment of clamping apparatus as proposed by the invention, wherein hydraulic circuitry 122 is provided that equips the apparatus for operation as what has been referred to previously as a basic and side-shifting clamping apparatus. In order to simplify the description of what is shown in FIG. 3, the same reference characters that were used in FIG. 2 have been used also in FIG. 3, to the extent possible, to designate like or identical components.

While clamping mechanism 16 as depicted in FIG. 3 is slightly different from mechanism 16 as depicted in FIG. 2, the practice of retaining identical reference characters has been followed here also. The essential difference between the two clamping mechnisms is that in the mechanism shown in FIG. 3 motor 22 is substantially the same size as motor 24.

Conduits 40, 42 supply and exhaust pressure fluid with respect to motors 22, 24 in this instance through a valving means shown within a dashed-double-dot block 124 which is also constructed in accordance with the present invention. As can be seen, this valving means includes many of the same components which were shown in FIG. 2 and which have already been described. Omitted from valving means 124 is a valve like valve 60, and in its place is provided a sealed, spring-biased, vented, pilot-operated check valve 126. Further included in valving means 124 are two additional valves including a pilot-operated check valve 128 and a vented pilot-operated check valve 130.

The seat and ball sides of valve 126 are connected through conduits 132, 134, respectively, with conduits 46, 50, respectively. Venting for this valve is provided by a conduit 136 which connects the valve with conduit 92. Piloting for valve 126 is accomplished through a conduit 138 which connects the valve with a conduit 140. Conduit 140 interconnects conduit 52 and the ball side of valve 130. The seat side of valve 130 connects through a conduit 142 with the upper side of spool 66 in FIG. 3. Venting for valve 130 is provided through a conduit 144 which connects with conduit 102.

Conduit 48 in the arrangement of FIG. 3 connects with two conduits 146, 148. Conduit 148 connects with the ball side of valve 128, the seat side of which connects with conduit 42 through a conduit 150. COnduits 102, 106, discussed earlier in connection with FIG. 2, in the case of the arrangement of FIG. 3 connect with conduit 150. Piloting for valve 128 is provided through a conduit 152 which connects with conduit 40. Piloting for valve 130 is accomplished through a conduit 153 which connects with conduit 152.

Finally, conduit 52, where it joins with conduit 140, also connects with a conduit 154. COnduits 146, 154 are referred to herein as another conduit means for the supply and exhaust of pressure fluid to motors 22, 24. It is these two conduits through which pressure fluid is supplied and exhausted to effect side-shifting of the arms in mechanism 16.

4. Operational Description For FIG. 3

Opening and closing of arms 18, 20 in the arrangement shown in FIG. 3 occurs in substantially exactly the same manner as opening and closing of the arms in the arrangement of FIG. 2. Just as was previously described, therefore, valve 54 switches motors 22, 24 between series and parallel-connected conditions depending upon the loaded and unloaded condition of the arms. Impeding of the arms, both during opening and closing, results in behavior in circuitry 122 like that described earlier in circuitry 27.

When it is desired to side-shift the arms to the left in FIG. 3, pressure fluid from the main supply of fluid on the truck is admitted to conduit 146, with conduit 154 then being connected to exhaust fluid. Pressure fluid then flows into the butt end of cylinder 28 shifting piston 30 to the left in FIG. 3, with fluid exhausting through conduits 46, 132, valve 126, and conduits 134, 50 to the rod end of cylinder 34. Accordingly, piston 36 shifts a like amount to the left in FIG. 3. Fluid exhausts from the butt end of cylinder 34 through conduit 52 to conduit 154.

Side-shifting of the arms to the right in FIG. 3 is accomplished by supplying pressure fluid to conduit 154, which fluid is then introduced to the butt end of cylinder 34. Piston 36 then shifts to the right in FIG. 3, with fluid exhausting from the rod end of cylinder 34 through conduits 50, 134, valve 126, and conduits 132, 46 to the rod end of cylinder 28. Accordingly, piston 30 shifts a like amount to the right in FIG. 3. Fluid exhausting from the butt end of cylinder 28 flows through to the right in FIG. 3, it will be noted that the pressure of fluid in conduit 154 which connects with conduits 140, 138, is greater than that of the fluid within conduit 136. Accordingly, valve 126 is piloted open to permit the escape of fluid from the rod end of cylinder 34.

Thus it will be seen how the apparatus of the invention meets the objectives, and offers the various advantages, ascribed to it earlier. Arm movement during closing and opening occurs at high speed, until both arms have gripped a load. Arm opening occurs at an especially high speed because of the regenerative flow condition which exists. When movement of a single arm becomes impeded, movement of the other arm continues.

A relatively small amount of pressure fluid flow is required to accomplish all closing and opening arm movement. Hence, time efficiency, and energy conservation (relative to the pumping of fluid), are maximized.

During arm closing, when an arm's movement becomes impeded, the novel valving arrangement provided switches the motors for the arms from a series-connected to a parallel-connected condition. This prepares the motors for a relatively high-power, low-speed clamping operation when both arms have engaged a load.

The proposed apparatus may be used not only simply for clamping and opening, but also for that in conjunction with side-shifting.

While two modifications of the invention have been shown and described herein, it will be apparent to those skilled in the art that changes and variations may be made without departing from the spirit of the invention.

What is claimed and desired to secure by Letters Patent is:

1. In a load-clamping apparatus including a pair of spaced, opposed, relatively movable clamping arms which are movable toward and away from each other, a pair of of fluid-operated motors, one for each arm, operatively connected to the arms for moving the same, conduit means for supplying pressure fluid to and exhausting it from said motors, and operating-mode-change fluid circuitry operatively interposed between said motors and said conduit means for determining the operating mode of said motors, said circuitry being responsive, during operation of said motors to shift the arms relatively toward one another, to the obstructed and nonobstructed conditions of the arms (respecting their contacting an external body) to place said motors in a series-connected condition under circumstances of both arms being unobstructed and freely moving, and in a parallel-connected condition under circumstances of either arm being obstructed and inhibited from moving.

2. The apparatus of claim 1, wherein said motors are of the double-acting type, with each including a cylinder having rod and butt ends respecting which pressure fluid may be supplied and exhausted, and said operating-mode-change circuitry is constructed whereby with the motors in a series-connected condition and the arms moving relatively toward one another, fluid exhausting from the butt end of one of the motors flows into the rod end of the other motor, and with the motors in a parallel-connected condition, fluid may flow simultaneously into like ends of the motors' cylinders and may exhaust simultaneously from like ends thereof.

3. The apparatus of claim 2, wherein said motors are of different sizes, with the effective working surface area for pressure fluid at the butt end of said one motor equalling that at the rod end of said other motor.

4. The apparatus of claim 2, wherein said motors are of substantially the same size, with substantially the same effective working surface areas for pressure fluid at the rod ends of the motors' cylinders, as well as at the butt ends of the cylinders.

5. The apparatus of claim 4 which further includes another conduit means for supplying pressure fluid to and exhausting it from said motors for the purpose of reversibly moving the clamping arms in a common direction without relative movement between the arms, thus to side-shift any load held by the arms.

6. The apparatus of claim 5, wherein said operating-mode-change circuitry further includes valving means which cooperates with said other conduit means, whereby with pressure fluid supplied in a manner causing simultaneous movement of the arms in one common direction, fluid exhausts from the rod end of one of the motors to the rod end of the other motor, and with pressure fluid supplied in a manner causing simultaneous movement of the arms in the reverse common direction, fluid exhausts from the rod end of said other motor to the rod end of said one motor.

7. The apparatus of claim 2, wherein said operating-mode-change circuitry further includes means capable of producing a connection between said motors whereby the same act to shift the arms relatively apart from one another, with the motors then being in a series-connected condition, and with such connection permitting fluid to exhaust from the rod end of said other motor's cylinder to the butt end of said one motor's cylinder, and further permitting fluid to exhaust from the rod end of said one motor's cylinder in a regenerative flow to the butt end of said other motor's cylinder.

8. The apparatus of claim 7, wherein said motors are of different sizes, with the effective working surface area for pressure fluid at the butt end of said one motor equalling that at the rod end of said other motor.

9. The apparatus of claim 7, wherein the motors are of substantially the same size, with substantially the same effective working surface areas for pressure fluid at the rod ends of the motors' cylinders, as well as at the butt ends of the cylinders.

10. In a load-clamping apparatus including a pair of opposed, relatively movable clamping arms which are movable relatively toward and away from each other in clamping and releasing modes, respectively, a pair of double-acting fluid-operated motors, one for each arm, operatively connected to the arms for moving the same in said two operating modes, conduit means for supplying pressure fluid to and exhausting it from said motors, and operating-mode-change fluid circuitry for said motors operatively interposed between said motors and said conduit means, responsive, during operation of the motors in a clamping mode, to the loaded and unloaded conditions of the arms (respectively their contacting an external body), to place the motors in a series-connected condition with both arms unloaded, and in a parallel-connected condition with either arm loaded.

11. In a load-clamping apparatus including a pair of opposed, relatively movable clamping arms which are movable relatively toward one another in a clamping mode to clamp onto a load, and relatively away from one another in a releasing mode to release a load, a pair of double-acting fluid-operated motors, one for each arm, operatively connected to the arms for moving the same in said two operating modes, conduit means for supplying pressure fluid to and exhausting it from said motors, and changeable-condition fluid-flow-directing means operatively interposed between said motors and said conduit means for directing fluid flow therebetween during operation of said motors in said clamping and releasing modes, said fluid-flow-directing means including means responsive, during said clamping mode, to the difference in pressure between a pair of spaced points in said conduit means to place said motors in a series-connected condition with such pressure difference below a certain level, and in a parallel-connected condition with the pressure difference above another level which is greater than said certain level.

12. In a load-clamping apparatus including a pair of opposed clamping arms which are movable toward and away from each other for clamping against and releasing a load, a pair of double-acting fluid-operated motors for moving the arms, each motor being operatively connected to a different one of the arms, conduit means for supplying pressure fluid to and exhausting it from said motors, and valving means operatively interconnecting said motors and said conduit means for directing fluid flow therebetween, said valving means including sensing means for sensing the difference in pressure at a pair of spaced-apart points in said conduit means, said sensing means effecting operation of said valving means to place said motors effectively in a series-connected condition with the sensed pressure difference being below a certain level, and effecting operation of the valving means to place the motors effectively in a parallel-connected condition with the sensed pressure difference being above another level which is greater than said certain level.

* * * * *